US008662189B2

(12) United States Patent
Harsono et al.

(10) Patent No.: US 8,662,189 B2
(45) Date of Patent: Mar. 4, 2014

(54) TUBING HANGER ASSEMBLY WITH SINGLE TRIP INTERNAL LOCK DOWN MECHANISM

(75) Inventors: Harsono Harsono, Singapore (SG); Andre Willy, Singapore (SG)

(73) Assignee: Cameron International Corporation, Houston, TX (US)

( * ) Notice: Subject to any disclaimer, the term of this patent is extended or adjusted under 35 U.S.C. 154(b) by 737 days.

(21) Appl. No.: 12/845,530

(22) Filed: Jul. 28, 2010

(65) Prior Publication Data

US 2012/0024540 A1 Feb. 2, 2012

(51) Int. Cl.
*E21B 23/03* (2006.01)
*E21B 23/00* (2006.01)

(52) U.S. Cl.
USPC ..... 166/382; 166/217

(58) Field of Classification Search
USPC ..... 166/382, 208, 217, 348
See application file for complete search history.

(56) References Cited

U.S. PATENT DOCUMENTS 4,595,063 A 6/1986 Jennings et al.
4,736,799 A 4/1988 Ahlstone
5,341,885 A 8/1994 Bridges
8,171,996 B2 * 5/2012 Jennings ..... 166/344
2005/0006107 A1 1/2005 Nguyen et al.

OTHER PUBLICATIONS

International Search Report for PCT/US2011/042072 dated Jan. 5, 2012.

* cited by examiner

*Primary Examiner* — Shane Bomar
*Assistant Examiner* — Wei Wang
(74) *Attorney, Agent, or Firm* — Chamberlain Hrdlicka

(57) ABSTRACT

A tubing hanger assembly for suspending a tubing string into a wellbore comprises a hanger body having a radially outer surface including external threads having a first thread handedness. In addition, the assembly comprises a load ring coaxially disposed about the hanger body. The load ring has a radially inner surface including a first set of internal threads that matingly engage with the external threads of the hanger body and a second set of internal threads having a second thread handedness that is opposite the first thread handedness. The load ring also has a radially outer surface including a frustoconical cam surface. Further, the assembly comprises an expandable ring disposed about the hanger body adjacent the lower end of the load ring. The expandable ring has a radially inner surface including a frustoconical surface that slidingly engages the cam surface. Still further, the assembly comprises a load sleeve coaxially disposed about the hanger body and having an upper end that engages the expandable ring.

18 Claims, 16 Drawing Sheets

TUBING HANGER ASSEMBLY WITH SINGLE TRIP INTERNAL LOCK DOWN MECHANISM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The invention relates generally to systems and methods for hanging tubulars from a wellhead into a wellbore. More particularly, the invention relates to a tubular hanger that is run and secured in the wellhead in a single trip without rotation.

2. Background of the Technology

Conventionally, wells in oil and gas fields are built up by establishing a wellhead housing at the surface and, with a drilling blow out preventer (BOP) adapter valve installed, drilling down to produce the borehole while successively installing concentric casing strings. The casing strings are cemented at their lower ends and sealed with mechanical seal assemblies at their upper ends. In order to prepare the cased well for production, a production tubing string is run into the cased borehole through the BOP, and a tubing hanger coupled to its upper end is landed in the wellhead. Thereafter the drilling BOP is removed and replaced by a Christmas tree having one or more production bores containing valves and extending vertically to respective lateral production fluid outlet ports in the wall of the tree.

In general, a tubing hanger is installed by a hanger running tool that lowers the hanger down the production bore of the wellhead until it lands on a stop shoulder. The stop shoulder is formed by a decreased inner diameter portion in a spool defining a section of the production bore of the wellhead. The shoulder provides a permanent means to stop the lowering of the tubing hanger, thereby locating the hanger within the wellhead.

One conventional method for retaining a hanger in a wellhead, often referred to as the tiedown screw method, requires drilling a plurality of bores through the wellhead spool. The bores extend radially through the spool to the production bore and are circumferentially spaced apart about the spool. A pin is inserted into each bore and extends partially into the production bore. Together, the plurality of pins define a reduced diameter shoulder in the production bore upon which the hanger is subsequently seated and/or retained. However, due to the multiple penetrations into the pressurized production bore, this approach may lead to undesirable leaks.

Other conventional methods for retaining a hanger in a wellhead often require two trips into the production bore of the wellhead—a first trip to land the hanger in the spool, and a second trip to lock the hanger in position within the spool. This approach presents some risks, especially during snubbing operations in which the hanger is positioned in the wellhead while the well still is under pressure (i.e., not killed). In particular, prior to locking the hanger in position, the hanger is subjected to the wellbore pressures, which presents the potential for well control issues. Moreover, many conventional two trip methods require rotation of the hanger to land and/or lock the hanger in position. However, rotation of the hanger subjected to wellbore pressures can be difficult and hazardous.

Accordingly, there remains a need in the art for apparatus, systems, and methods for landing and retaining a tubing hanger within a wellhead. Such apparatus, systems, and methods would be particularly well received if they did not require penetration of the spool and enabled a single-trip approach without rotation to both land and lock the tubing hanger within the spool.

BRIEF SUMMARY OF THE DISCLOSURE

These and other needs in the art are addressed in one embodiment by a tubing hanger assembly for suspending a tubing string into a wellbore. In an embodiment, the assembly comprises a hanger body having a central axis, an upper end, a lower end, and a through bore extending axially between the upper and lower ends. The hanger body has a radially outer surface including external threads axially disposed between the upper end and the lower end, the external threads having a first thread handedness. In addition, the assembly comprises a load ring coaxially disposed about the hanger body. The load ring has an upper end and a lower end, wherein the load ring has a radially inner surface including a first set of internal threads that matingly engage with the external threads of the hanger body and a second set of internal threads axially spaced above the first set of external threads, the second set of external threads having a second thread handedness that is opposite the first thread handedness. The load ring has a radially outer surface including a frustoconical cam surface extending from the lower end of the load ring. Further, the assembly comprises an expandable ring disposed about the hanger body and axially positioned adjacent the lower end of the load ring. The expandable ring has a radially inner surface including a frustoconical surface that slidingly engages the cam surface. Still further, the assembly comprises a load sleeve coaxially disposed about the hanger body and having an upper end that engages the expandable ring and a lower end distal the expandable ring. The load sleeve has a radially outer surface including an annular load shoulder.

These and other needs in the art are addressed in another embodiment by a production assembly for controlling production from a well. In an embodiment, the assembly comprises a a wellhead including a spool. The spool has a through bore including an annular hanger support shoulder and an annular recess axially spaced above the support shoulder. In addition, the assembly comprises a tubing hanger assembly installable in the throughbore. The tubing hanger assembly includes a hanger body coaxially disposed in the through bore and having an upper end and a lower end. The tubing hanger assembly also includes an expandable ring disposed about the hanger and engaging the annular recess of the through bore. The expandable ring is a snap ring that is biased radially inward. Further, the tubing hanger assembly includes a load ring coaxially disposed about the hanger body. The radially outer surface of the load ring includes a cam surface that engages a radially inner surface of the expandable ring and is adapted to maintain engagement of the load ring with the annular recess of the through bore. Still further, the tubing hanger assembly includes a load sleeve coaxially disposed about the hanger body and axially positioned below the load ring. The load sleeve has a radially inner surface that engages the hanger body and a radially outer surface including an annular shoulder that engages the support shoulder of the through bore. Moreover, the production assembly comprises a production tubing string hung from the lower end of the hanger body and extending into the well.

These and other needs in the art are addressed in another embodiment by a method. In an embodiment, the method comprises (a) installing a wellhead including a spool and a bore through the spool, the bore including an annular recess and an annular hanger landing shoulder axially disposed below the recess. In addition, the method comprises (b) lowering a tubing hanger assembly into the bore. The tubing hanger assembly includes a hanger body having a central axis, an upper end, and a lower end. Further, the tubing hanger assembly includes a load ring coaxially disposed about the hanger body. The load ring has an upper end and a lower end, and the load ring has a radially outer surface including a frustoconical cam surface extending from the lower end of the load ring. Still further, the tubing hanger assembly includes an expandable ring disposed about the hanger body and axially positioned adjacent the lower end of the load ring. The expandable ring has a radially inner surface including a frustoconical surface that slidingly engages the cam surface. Moreover, the tubing hanger assembly comprises a load sleeve coaxially disposed about the hanger body and having an upper end that engages the expandable ring and a lower end distal the expandable ring. The load sleeve has a radially outer surface including an annular load shoulder. The method also comprises (c) landing the load shoulder of the load sleeve against the landing shoulder of the bore. Moreover, the method comprises (d) locking the tubing hanger assembly to the spool within the bore by expanding the expandable ring radially outward into the annular recess. Operations (b), (c), and (d) are performed in a single trip without rotation into the bore.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
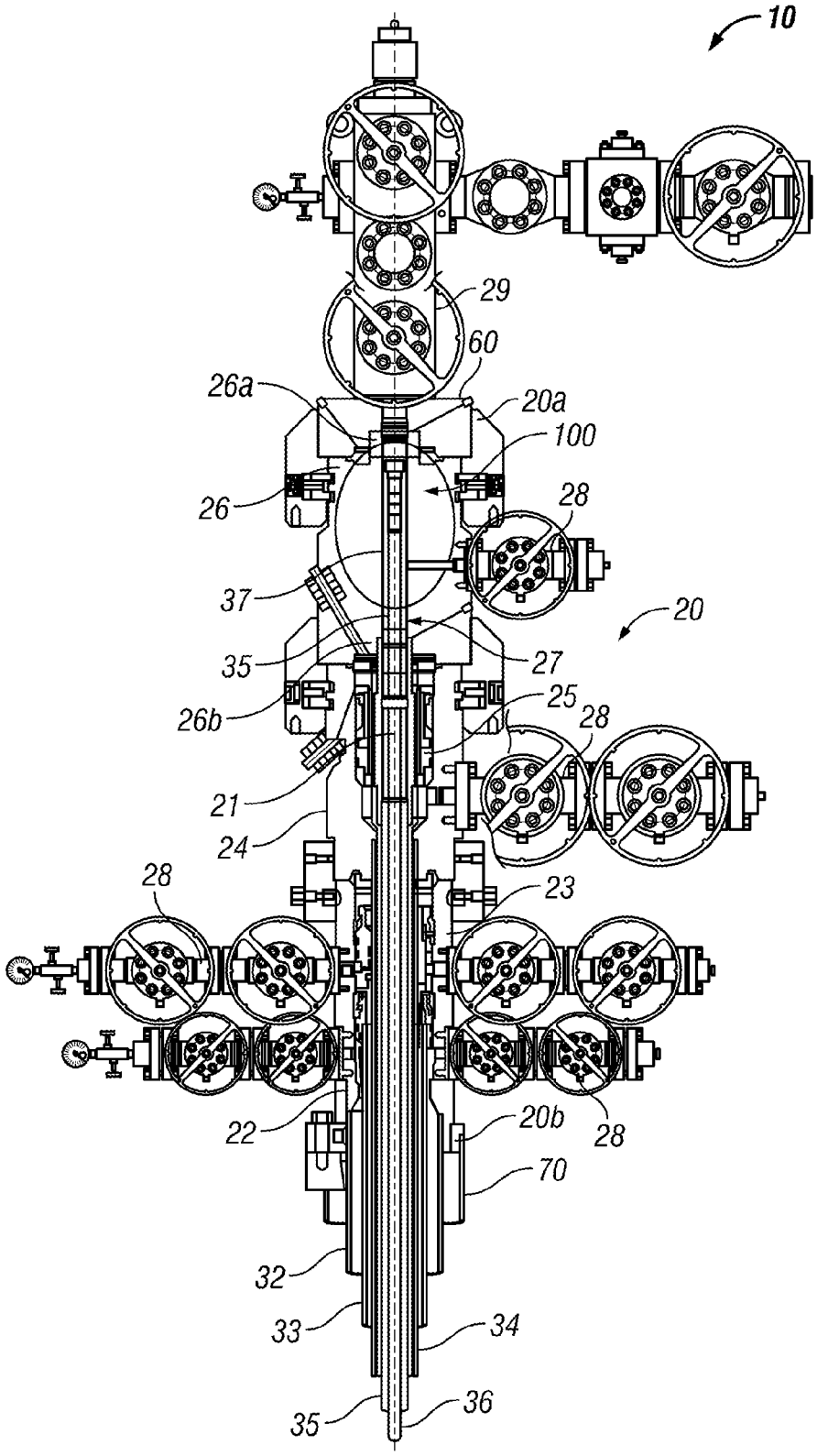
FIG. 1 is a partial cross-sectional view of a production system including an embodiment of a tubing hanger assembly in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of a production system 10 is shown. System 10 includes a wellhead 20 having a first or upper end 20*a* coupled to a Christmas Tree 60 and a second or lower end 20*b* coupled to a conductor casing 70. In general, wellhead 20 controls and monitors flow, temperature, and pressure of the production fluid or gas via a plurality of valves and tubing inside production system 10. Christmas Tree 60 and conductor casing 70 may be secured to wellhead 20 using bolts or other suitable attachment means. Wellhead 20 also includes a plurality of casing spools 22, 23, 24 and a pair of tubing spools 25, 26. Spools 22-26 are coupled together and arranged in a generally vertical stack. Together, spools 22-26 define a central through bore 27 extending axially through wellhead 20 from lower end 20*a* to upper end 20*b*. Through bore 27 has a central axis 21.

Casing strings 32, 33, 34 are hung from casing spools 22, 23, 24, respectively, and a tubing string 35, 36 is hung from each tubing spool 25, 26, respectively. Strings 32-36 extend downhole from wellhead 20 and are supported by spools 22-26, respectively. Strings 32-36 are coaxially aligned and configured in a nested arrangement. Tubing string 36 is the innermost string that is run/installed later in the life of the well through Christmas Tree 60, and functions to produce wellbore fluids (e.g., oil and/or gas) to the surface. More specifically, in this embodiment, tubing string 36 is a velocity string employed as a remedial treatment to resolve liquid-loading problems in the well by reducing the production flow area and increasing the flow velocity to enable liquids to be carried from the wellbore. Accordingly, tubing string 36 may also be referred to as a "production tubing string" or a "velocity string," and tubing spool 26 may be referred to as a "production spool" or velocity spool." Wellhead also includes a plurality of valves 28 that provide access to and controls fluid flow through the annulus formed between each pair of axially adjacent strings 32-36. Christmas Tree 60 provides access to and controls fluid flow through the radially innermost tubing string 36.

Referring still to FIG. 1, a tubing or velocity hanger assembly 100 secures tubing string 36 to spool 26. As will be described in more detail below, tubular hanger 100 is lowered through the top of Christmas Tree 60, landed in spool 26, and releasably locked into engagement with spool 26, thereby restricting and/or preventing axial movement of hanger 100 and tubing string 36 coupled thereto, which are subject to wellbore pressures during snubbing operations.

Figure 2:
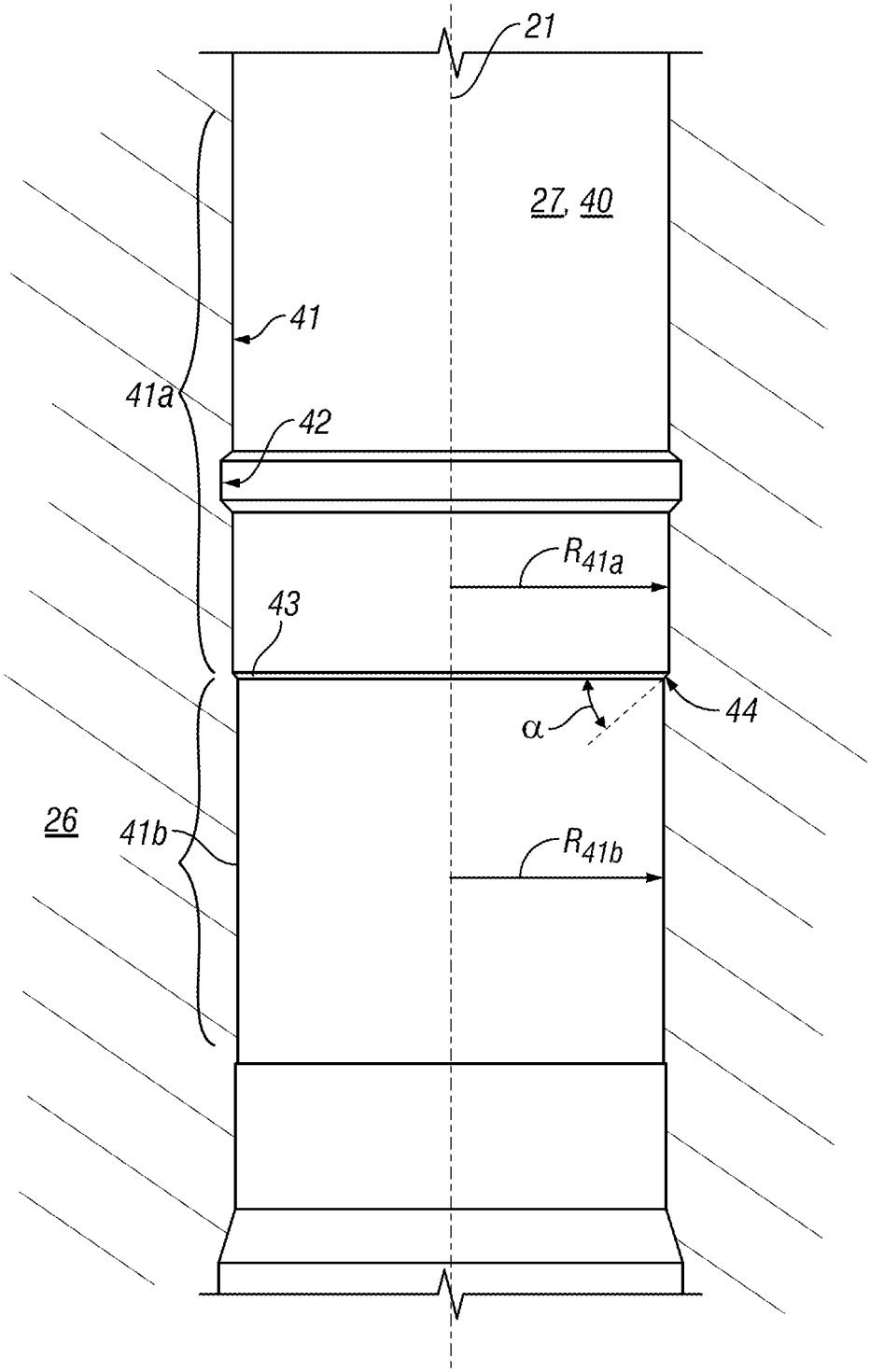
FIG. 2 is an enlarged partial cross-sectional view of the production tubing spool of FIG. 1.

Referring now to FIGS. 1 and 2, spool 26 has a first or upper end 26*a*, a second or lower end 26*b*, and a through bore 40 extending axially between ends 26*a,b*. Bore 40 defines an axial section of wellhead bore 27. As best shown in FIG. 2, spool 26 has a radially inner surface 41 extending axially between ends 26*a,b* and defining bore 40. Surface 41 may be divided into a first or upper section 41a and a second or lower section 41*b* extending axially downward from upper section 41*a*. In this embodiment, upper section 41*a* of radially inner surface 41 includes an annular recess 42 axially spaced above lower section 41*b*. Other than recess 42, inner surface 41 is cylindrical and disposed at a radius $R_{41a}$ within upper section 41*a*. Within lower section 41*b*, inner surface 41 is also cylindrical, however, inner surface 41 is disposed at a second radius $R_{41b}$ in lower section 41*b* that is less than first radius $R_{41a}$. Consequently, an annular stop or hanger support shoulder 43 is formed along inner surface 41 at the intersection of sections 41*a,b*. Shoulder 43 includes a frustoconical transition surface 44 extending radially between sections 41*a,b*. Transition surface 44 is disposed at a shoulder angle $\alpha$ relative to a plane perpendicular to axis 21 as viewed in cross-section in a plane containing axis 21 (e.g., FIG. 2). Shoulder angle $\alpha$ is preferably between 30° and 60°, and more preferably 45°. In this embodiment, shoulder angle $\alpha$ is 45°, and thus, shoulder 43 may be described as a 45° shoulder.

Figure 3:
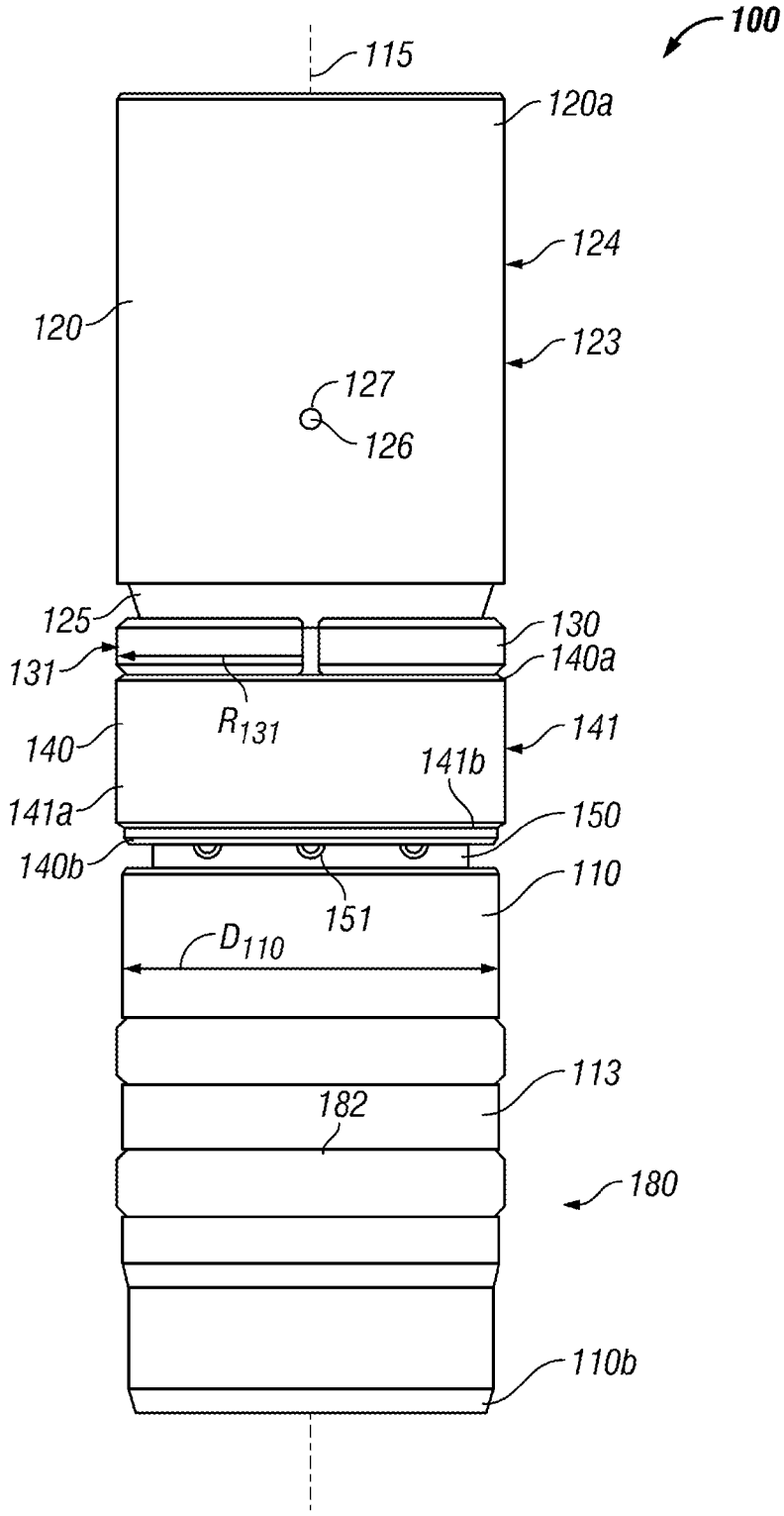
FIG. 3 is a side view of the tubing hanger assembly of FIG. 1.
Figure 4:
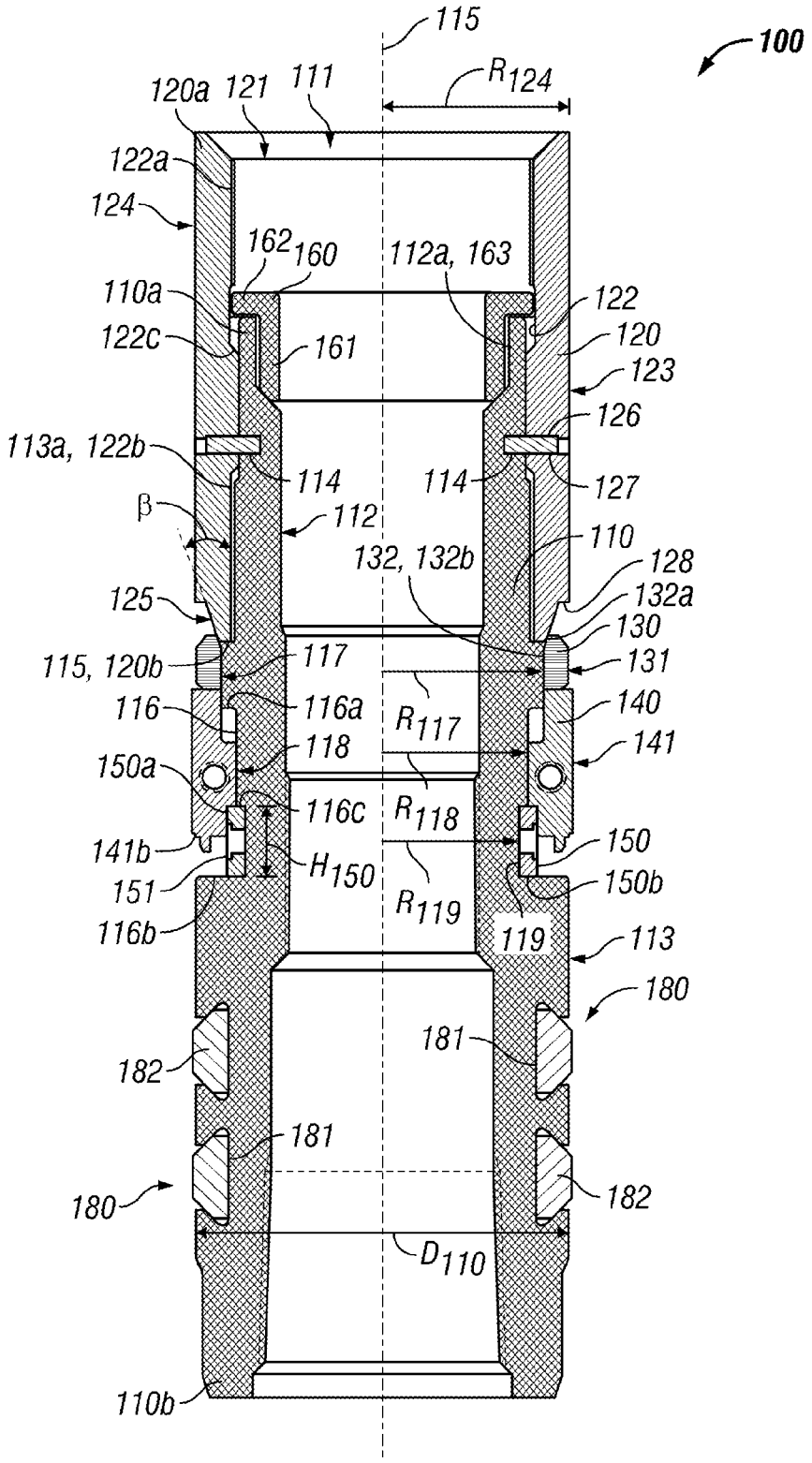
FIG. 4 is a cross-sectional view of the tubing hanger assembly of FIG. 1.

Referring now to FIGS. 3 and 4, tubing hanger assembly 100 includes a generally cylindrical hanger body 110 having a central axis 115, a load ring 120, an expandable lock ring 130, a load sleeve 140, a snap ring 150, and a retaining ring 160. Each ring 120, 130, 140, 150, 160 is coaxially aligned with body 110. Further, rings 120, 130, 140 are disposed about body 110, whereas ring 150 is received by body 110.

As best shown in FIG. 4, body 110 extends axially between an upper end 110*a* and a lower end 110*b*, and includes a central through bore 111 extending between ends 110*a,b*. Body 110 has a maximum outer diameter $D_{110}$ that is less than twice the radius $R_{41a}$ and the same or slightly less than twice the radius $R_{41b}$. In addition, body 110 has a radially inner surface 112 defined by bore 111 and a radially outer surface 113. Inner surface 112 includes internal threads 112*a* at upper end 110*a*.

Outer surface 113 includes external threads 113*a* proximal upper end 110*a*, an annular shoulder 115 axially adjacent and below threads 113*a*, a stepped recess 116 axially disposed between shoulder 115 and lower end 110*b*, and a cylindrical surface 117 extending axially between shoulder 115 and recess 116. Surface 117 is disposed at a radius $R_{117}$.

Referring still to FIG. 4, stepped recess 116 extends axially between an upper annular shoulder 116*a* and a lower annular shoulder 116*b*, and includes an upper cylindrical surface 118 extending axially downward from shoulder 116*a* and a lower cylindrical surface 119 extending axially upward from shoulder 116*b*. Surface 118 is disposed at a radius $R_{118}$ that is less than radius $R_{117}$ and surface 119 is disposed at a radius $R_{119}$ that is less than radius $R_{117}$ and radius $R_{118}$. As a result of the differences in radii $R_{118}$, $R_{119}$, an intermediate annular shoulder 116*c* extends between surfaces 118, 119. In this embodiment, each annular shoulder 116*a,b,c* is defined by an annular planar surface disposed in a plane perpendicular to axis 115.

As shown in FIG. 1, when employed to hang tubing string 36 within spool 26, tubing string 36, which is a velocity string in this embodiment as previously described, is coupled to lower end 110*b* of hanger body 110. In this embodiment, lower end 110*b* comprises a box end that threadingly receives an upper pin end of tubing string 36. However, in other embodiments, other means and mechanisms may be employed to attach the tubing string (e.g., tubing string 36) to the lower end of the hanger body (e.g., lower end 110*b* of hanger body 110).

Referring again to FIGS. 3 and 4, load ring 120 has an upper end 120*a*, a lower end 120*b*, and a central through bore 121 extending between ends 120*a,b*. In addition, ring 120 has a radially inner surface 122 defined by bore 121 and a radially outer surface 123. Inner surface 122 includes internal threads 122*a* at upper end 120*a* and internal threads 122*b* at lower end 120*b*. Internal threads 122*a,b* are opposite handed. For example, if threads 122*a* are right handed threads, then threads 122*b* are left handed threads, and alternatively, if threads 122*a* are left handed threads, then threads 122*b* are right handed threads. In this embodiment, threads 122*a* are right handed threads and threads 122*b* are left handed threads. In addition inner surface 122 includes an annular shoulder 122*c* axially disposed between threads 122*a,b*.

Outer surface 123 includes a cylindrical surface 124 extending from upper end 120*a*, a frustoconical cam surface 125 extending from lower end 120*b*, and an annular shoulder 128 extending radially therebetween. Surface 124 is disposed at a radius $R_{124}$ that is the same or slightly less than the radius $R_{41a}$ of spool bore 40. Cam surface 125 is oriented at a cam angle $\beta$ relative to inner surface 122 and central axis 115 as viewed in cross-section in a plane containing axis 115 (e.g., FIG. 4). Cam angle $\beta$ is preferably between 5° and 45°, and more preferably between 10° and 25°. In this embodiment, cam angle $\beta$ is 15°.

Load ring 120 is coaxially disposed about upper end 110*a* of hanger body 110 and retainer ring 160, and is releasably coupled to hanger body 110. In this embodiment, hanger body 110 is threaded into bore 121 of load ring 120 via engagement of mating threads 113*a*, 122*b* until lower end 120*b* of load ring 120 axially abuts shoulder 115 of hanger body 110. In addition, a plurality of circumferentially spaced shear pins 126 extend radially through mating bores 127 in load ring 120 and into mating bores 114 in outer surface 113 of hanger body 110.

Referring still to FIGS. 3 and 4, expandable ring 130 is coaxially disposed about cylindrical surface 117 of hanger body 110 and is axially positioned between load ring 120 and load sleeve 140. As will be described in more detail below, expandable ring 130 slidingly engages frustoconical cam surface 125 of load ring 120 when load ring 120 moves axially relative to expandable ring 130.

Figure 8:
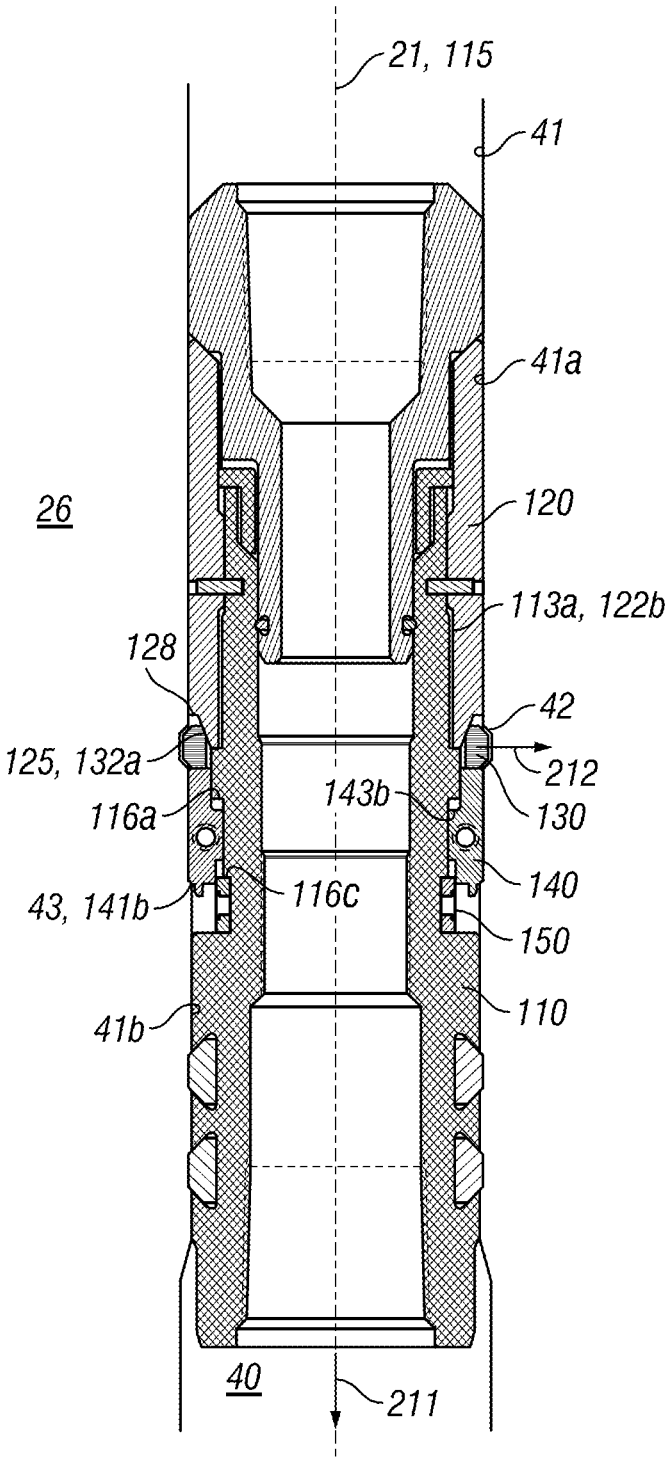
Figure 9:
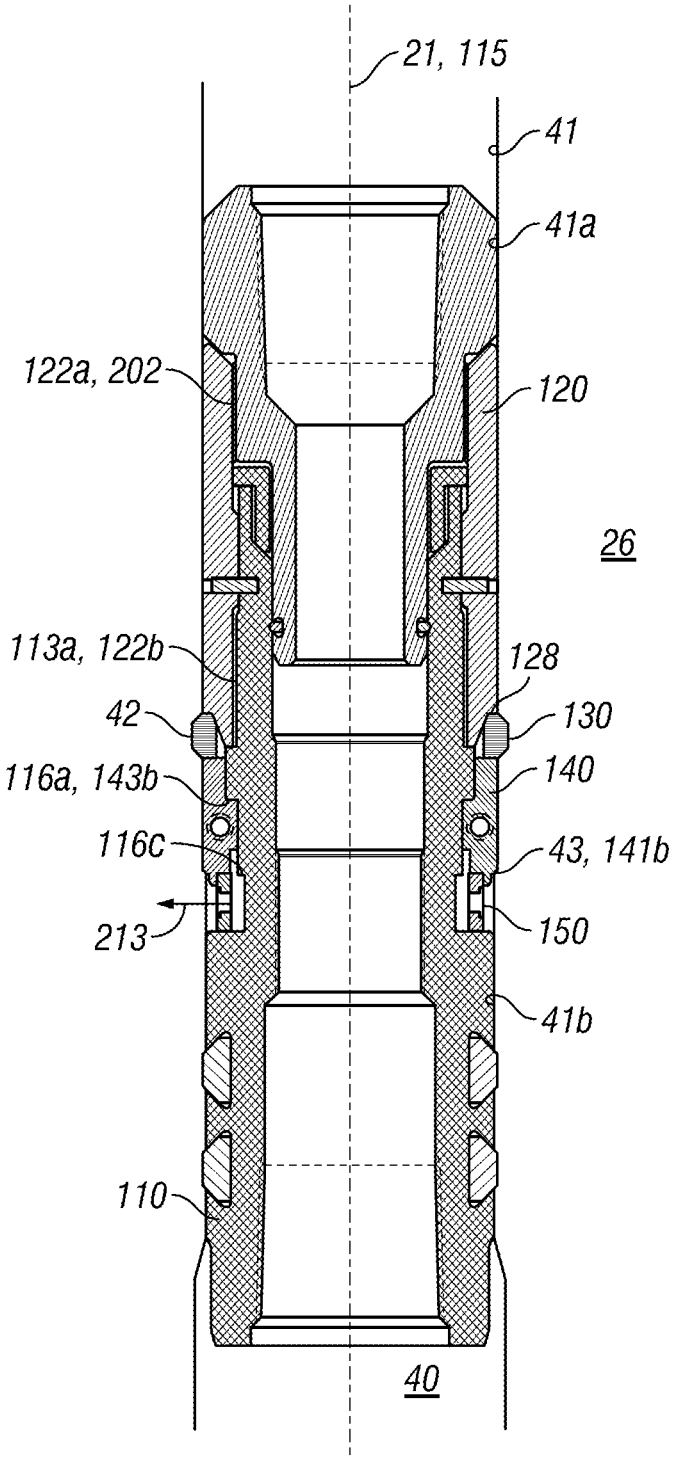

As best shown in FIGS. 8 and 9, expandable ring 130 has a radially outer surface 131 configured to mate and engage with recess 42 of spool 26, and a radially inner surface 132 including a frustoconical surface 132*a* radially opposed cam surface 125 of load ring 120 and a cylindrical surface 132*b* radially opposed surface 117 of body 110. Surface 132*a* is configured to mate with and slidingly engage cam surface 125. In particular, surface 132*a* is oriented at the same cam angle $\beta$ previously described relative to inner surfaces 117, 122 and central axis 115 as viewed in cross-section in a plane containing axis 115 (e.g., FIG. 4).

As will be described in more detail below, during run in and locking operations with hanger assembly 100, expandable ring 130 is configured to expand radially outward into engagement with spool recess 42 to lock hanger assembly 100 within spool 26 as shown in FIGS. 8 and 9. Specifically, expandable ring 130 may be described has having an undeformed, relaxed position shown in FIGS. 4 and 7, and a deformed, expanded position shown in FIG. 9. Thus, expandable ring 130 is biased radially inward (i.e., expandable ring 130 is biased to the undeformed, relaxed position having a radius less than the deformed, expanded position). In the undeformed position shown in FIGS. 4 and 7, inner surface 132*a* contacts cam surface 125 at lower end 120*b*, inner surface 132*b* is radially proximal surface 117 of hanger body 110, and ring 130 does not extend radially into recess 142. However, in the undeformed, relaxed position, outer surface 131 extends to a radius $R_{131}$ that is slightly less than the radius $R_{41a}$ of spool bore 40. In the deformed, expanded position shown in FIG. 9, inner surface 132*a* still engages cam surface 125, however, inner surface 132*b* is radially spaced apart from surface 117 of hanger body 110, ring 130 extends radially into and engages recess 142. As will be described in more detail below, in the deformed, expanded position, ring 130 restricts and/or prevents hanger assembly 100 from moving axially relative to spool 26, thereby locking hanger assembly 100 within spool 26. Accordingly, the deformed, expanded position may also be described as a locking position.

In this embodiment, expandable ring 130 is a snap ring that is elastically deformed, disposed about body 110, and allowed to snap back toward its unstressed position about surface 117. Thus, expandable ring 130 preferably comprises a resilient, durable material capable of being periodically transitioned between an undeformed, relaxed position and a deformed, radially expanded position. In addition, expandable ring 130 preferably comprises a material suitable for use with the harsh conditions in the wellhead (e.g., high pressures, high temperatures, exposure to corrosive fluids, etc.). Examples of suitable materials include, without limitation, metals and metal alloys such as steel, low alloy steel, stainless steel, or inconel.

Referring again to FIGS. 3-5, load sleeve 140 is coaxially disposed about hanger body 110 and is axially positioned between expandable ring 130 and lower shoulder 116*b* of hanger body recess 116. As will be described in more detail below, load sleeve 140 slidingly engages surfaces 117, 118 of body 110 during run in and locking operations with hanger assembly 100.

Figure 5:
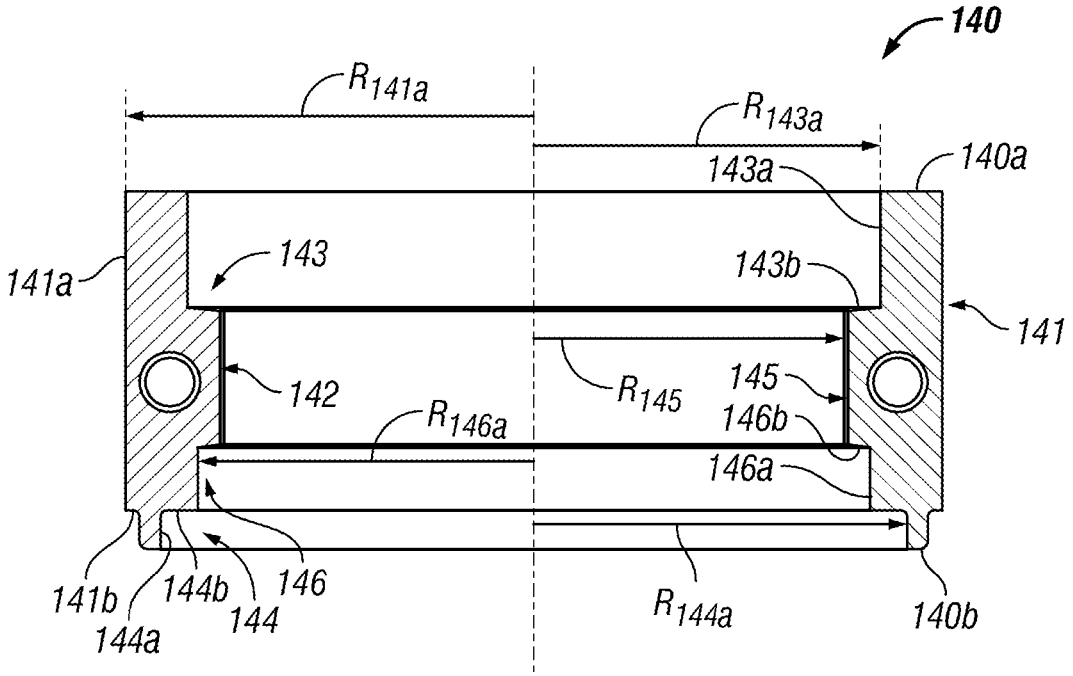
FIG. 5 is an enlarged cross-sectional view of the energizing ring of the tubing hanger assembly of FIG. 1.
Figure 7:
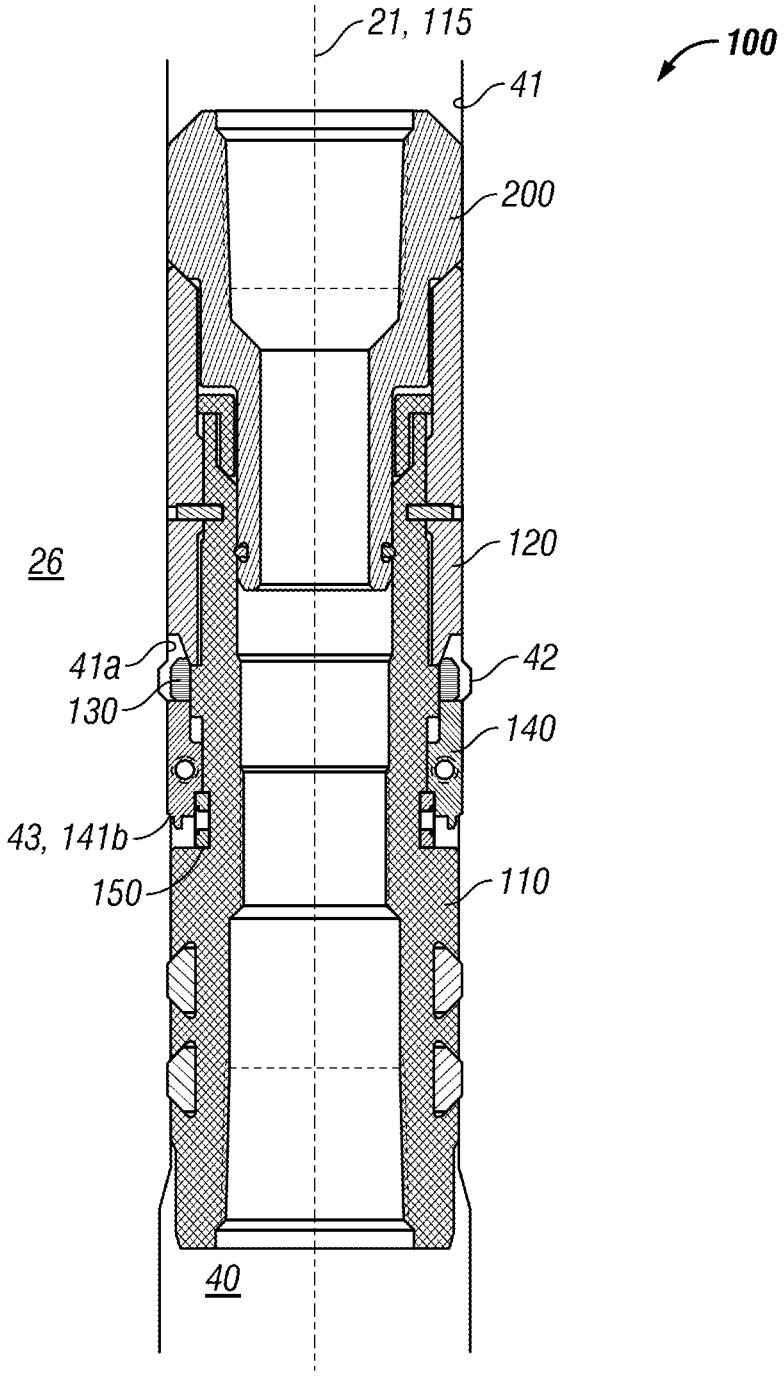

As best shown in FIGS. 4 and 5, load sleeve 140 has a first or upper end 140*a*, a second or lower end 140*b*, a radially outer surface 141 extending between ends 140*a,b,* and a radially inner surface 142 extending between ends 140*a,b*. Radially outer surface 141 includes a cylindrical surface 141*a* extending axially from upper end 140*a* and an annular shoulder 141*b* axially positioned between surface 141*a* and lower end 140*b*. Surface 141*a* is and disposed at a radius $R_{141a}$ that is greater than half the diameter $D_{110}$. Further, radius $R_{141a}$ is slightly less than spool bore radius $R_{41a}$ and greater than spool bore radius $R_{41b}$. Thus, during installation and retrieval of assembly 100 from bore 40 of spool 26, surface 141 a slidingly engages inner surface 41*a,* but is prevented from passing through lower section 41*b* of spool 26. Shoulder 141*b* extends radially inward from surface 141*a,* and as shown in FIG. 7, is configured to mate and engage with spool shoulder 43. In particular, shoulder 141*b* is oriented at the same shoulder angle $\alpha$ previously described relative to a plane perpendicular to axis 115 as viewed in cross-section in a plane containing axis 115 (e.g., FIG. 4).

Referring still to FIGS. 4 and 5, inner surface 142 is a stepped surface configured to mate with stepped recess 116 of hanger body 110. Specifically, inner surface 142 includes a first annular recess 143 at upper end 140*a*, a second annular recess 144 at lower end 140*b*, a radially innermost cylindrical surface 145 axially adjacent and below recess 143, and a third annular recess 146 axially adjacent and above recess 144 and axially adjacent and below surface 145. Surface 145 is disposed at a radius $R_{145}$ that is slightly greater than radius $R_{118}$ previously described, and thus, surface 145 may slidingly engages surface 118 of hanger body recess 116.

Recess 143 is defined by a cylindrical surface 143*a* extending axially from upper end 140*a* and an annular shoulder 143*b* extending radially from surface 143*a* to radially innermost surface 145. Surface 143*a* is disposed at radius $R_{143a}$ that is slightly greater than $R_{117}$ and slidingly engages surface 117 of hanger body 110. Recess 146 is defined by a cylindrical surface 146*a* and an annular shoulder 146*b* extending radially from surface 146*a* to radially innermost surface 145. Surface 146*a* is disposed at a radius $R_{146a}$ that is greater than radius $R_{118}$. Recess 144 is defined by a cylindrical surface 144*a* extending axially from lower end 140*b* and an annular shoulder 144*b* extending radially from surface 144*a* to surface 146*a*. Surface 144*a* is disposed at a radius $R_{144a}$ that is greater than radius $R_{146a}$. As will be described in more detail below, recesses 144, 146 are sized and positioned to receive snap ring 150, and restrict and/or prevent snap ring 150 from expanding radially beyond radius $R_{144a}$, $R_{146a}$, respectively.

In this embodiment, load sleeve 140 is a split ring made from multiple partial ring components that are formed around body 110 in multiple components (e.g., two or three piece split ring), and then secured together. Load sleeve 140 preferably comprises a rigid material suitable for use with the harsh conditions in the wellhead (e.g., high pressures, high temperatures, exposure to corrosive fluids, etc.). Examples of suitable materials include, without limitation, metals and metal alloys such as steel, low alloy steel, stainless steel, or inconel.

Referring again to FIGS. 3 and 4, snap ring 150 is coaxially disposed about hanger body 110 within recess 116, is axially positioned between load sleeve 140 and shoulder 116*b*, and is radially positioned between surface 119 and load sleeve 140. Snap ring 150 has a first or upper end 150*a* that slidingly engages shoulders 116*c*, 144*b*, 146*b*, and a second or lower end 150*b* that slidingly engages recess lower shoulder 116*b*. In addition, snap ring 150 has a height $H_{150}$ measured axially between ends 150*a,b* that is slightly less than the distance measured axially between shoulders 116*b,c*. Thus, snap ring 150 is sized and configured to fit axially between shoulders 116*b,c*.

Figure 6:
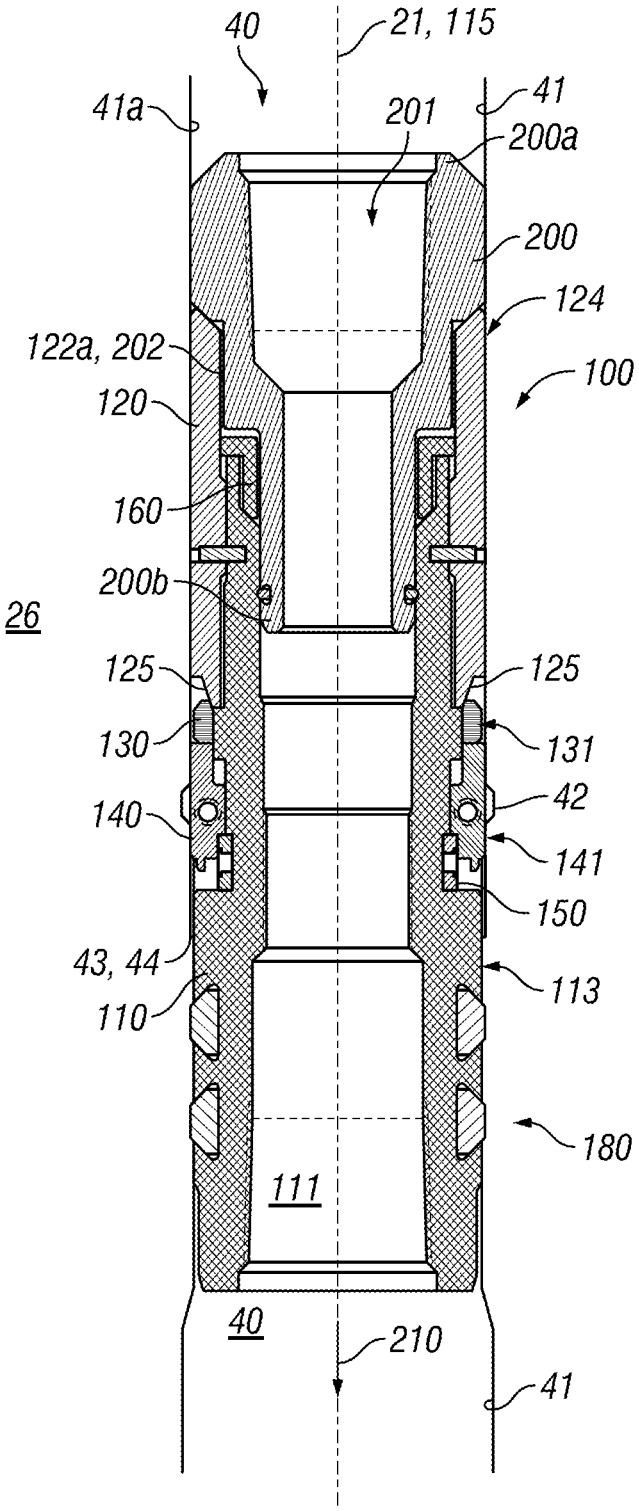
FIGS. 6-11 are sequential cross-sectional views of the tubing hanger assembly of FIG. 2 being landed and locked in the spool of the production assembly of FIG. 1 in a single trip.
Figure 10:
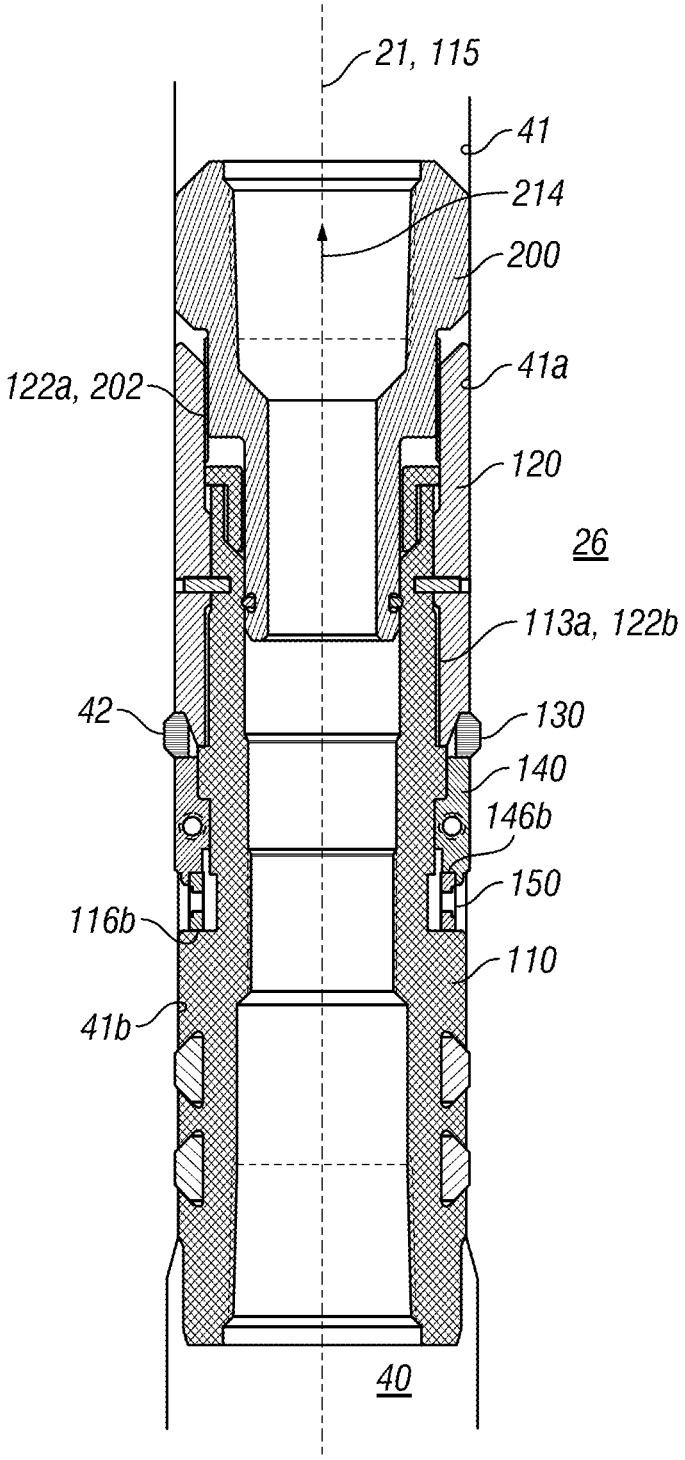

As will be described in more detail below, during run in and locking operations with hanger assembly 100, snap ring 150 is configured to first expand radially outward into engagement with recess 146 of load sleeve 140 as shown in FIGS. 4 and 6, and then expand radially outward into engagement with recess 144 of load sleeve 140 as shown in FIGS. 9 and 10. Specifically, snap ring 150 may be described has having an undeformed, relaxed position with an outer diameter greater than twice the radius $R_{144a}$ as shown in FIG. 5, and a plurality of deformed, radially compressed position shown in FIGS. 3, 4, 7, 9, and 10. Thus, snap ring 150 is biased radially outward (i.e., snap ring 150 is biased to the undeformed, relaxed position having a radius greater than the deformed, compressed position). Consequently, snap ring 150 is radially compressed in order to position it radially between hanger body 110 and load sleeve 140. For assembly purposes, a plurality of circumferentially spaced apart holes 151 extending radially through snap ring 150 provide a means to radially compress snap ring 150 and hold the deformed, compressed position while energizing ring is disposed about hanger body 110 and slid down over snap ring 150.

In the first deformed position shown in FIGS. 3 and 4, snap ring 150 is disposed in recess 146 and engages surface 146*a*, and in the second deformed position shown in FIG. 10, snap ring 150 is disposed in recess 144 and engages surface 144*a*. As will be described in more detail below, in the deformed, expanded positions shown in FIGS. 3, 4, 7, 9, and 10, snap ring 150 restricts and/or prevents load sleeve 140 from moving axially downward toward shoulder 116*b* of hanger body 110.

In this embodiment, snap ring 150 is disposed about body 110, radially compressed against surface 119, and held in this position via holes 151 until load sleeve 140 is slid down over snap ring 150, at which time snap ring 150 may be allowed to snap back and expand radially outward into engagement with recess 146 and toward its unstressed position. Thus, snap ring 150 preferably comprises a resilient, durable material capable of being transitioned between an undeformed, relaxed position and a plurality of deformed, radially compressed positions. In addition, snap ring 150 preferably comprises a material suitable for use with the harsh conditions in the wellhead (e.g., high pressures, high temperatures, exposure to corrosive fluids, etc.). Examples of suitable materials include, without limitation, metals and metal alloys such as steel, low alloy steel, stainless steel, inconel.

Referring again to FIG. 4, retainer ring 160 is coaxially received by hanger body 110 at upper end 110*a* and has a first or upper end 160*a* and a second or lower end 160*b*. In this embodiment, retainer ring 160 has a generally inverted L-shaped cross-section including a cylindrical base portion 161 extending axially from lower end 160*b* and an annular flange portion 162 extending radially outward from base portion 161 at upper end 160*a*. Base portion 161 is disposed within bore 111, and flange portion 162 axially abuts upper end 110*a* and extends radially outward over upper end 110*a* and beyond outer surface 113 at upper end 110*a*. Retainer ring 160 is coupled to hanger body 110 via external threads 163 disposed about the radially outer surface of base portion 161.

Referring again to FIGS. 3 and 4, in this embodiment, tubing hanger assembly 100 also includes a plurality of seal assemblies 180. As will be described in more detail below, seal assemblies 180 function to form annular seals with body 110 and spool 26, thereby restricting and/or preventing the axial flow of fluids between body 110 and spool 26.

In this embodiment, each seal assembly 180 comprises an annular recess or seal gland 181 formed in outer surface 113 of hanger body 110 proximal lower end 110*b*, and an annular seal member 182 disposed within seal gland 181. Annular seal members 182 are resilient seals capable of being radially compressed between body 110 and spool 26 when tubing hanger assembly 100 is disposed within spool bore 40.

In use, a downhole completion is initiated by drilling and completing an oil or gas production well in such a manner that the well can allow proper flow during the period in which the reservoir operates. Production system 10 shown in FIG. 1 may be used for completing the well with the tubing hanger assembly 100, and tubing string 36 hung therefrom, installed in wellhead 20, and more specifically spool 26, to allow communication and control of downhole functions and as a sealing mechanism for the production components that are utilized in the operation of the well.

Referring now to FIGS. 6-11, the sequential steps for running tubing hanger assembly 100 into spool 26, and locking assembly 100 to spool 26 are shown. In particular, FIGS. 6 and 7 illustrate tubing hanger assembly 100 being lowered into spool bore 40, FIGS. 8 and 9 illustrate tubing hanger assembly 100 being locked and secured within spool bore 40 after being run in according to FIGS. 6 and 7, and FIGS. 10 and 11 illustrate backing out of a running tool used to lower and position hanger assembly 100 within bore 40 after hanger assembly 100 is locked and secured to spool 26 according to FIGS. 8 and 9. For purposes of clarity, tubing string 36 coupled to lower end 110*b* of hanger body 110 is not shown in FIGS. 6-11. However, as shown in FIG. 1, tubing string 36 is hung from the lower end 110*b* of hanger body 110 during run in, production, and retrieval operations.

In general, tubing hanger assembly 100 is installed in spool 26 and retrieved from spool 26 with a hanger running tool 200. In this embodiment, running tool 200 has an upper end 200*a*, a lower end 200*b*, and a through bore 201 extending between ends 200*a,b*. The radially outer surface of running tool 200 includes external threads 202 that threadingly engage mating with internal threads 122*a* of load ring 120. For installation and retrieval of tubing hanger assembly 100, tool 200 is threaded into bore 121 of load ring 120 via mating threads 122*a*, 202. With tool 200 secured to hanger assembly 100, tool 200 may be used to position assembly 100 within spool 26.

Referring now to FIGS. 6 and 7, lowering of tubing hanger assembly 100 into spool bore 40 will be described. Using tool 200, assembly 100 is coaxially inserted and axially advanced downward in the direction of arrow 210 through bore 40 in spool 26 toward recess 42 and shoulder 43. As previously described, radially outer surfaces 124, 131, 141*a* are disposed at radii $R_{124}$, $R_{131}$, $R_{141a}$, respectively, that are slightly less than radius $R_{41a}$ of upper section 41*a*. Consequently, surfaces 124, 131, 141 may slidingly engage upper section 41*a* of spool bore inner surface 41 as assembly 100 is axially advanced through bore 40. To ensure expandable ring 130 does not inadvertently latch or engage edges, shoulders, or recesses in route to recess 42 (e.g., recesses at transitions between adjacent spool bores), the maximum outer diameter of expandable ring 130 is preferably less than the maximum outer diameter of load ring 120 and preferably less than the maximum outer diameter of load sleeve 140 (i.e., less than twice the radius $R_{141a}$). In other embodiments, the expandable ring (e.g., expandable ring 130) may be restrained in position relative to the remainder of the hanger assembly (e.g., assembly 100) during delivery with a shear pin or other feature that fixes the expandable ring relative to the hanger assembly until engagement of the load sleeve (e.g., load sleeve 140) with the desired spool bore shoulder (e.g., shoulder 43)—the shear pin gets sheared upon landing of the load sleeve on the desired spool bore shoulder. Further, to aid in the desired coaxial alignment of hanger assembly 100, the maximum outer diameter of load ring 120 is preferably the same as the maximum outer diameter of load sleeve 140 (i.e., twice the radius $R_{141a}$), and both the maximum outer diameter of load ring 120 and load sleeve 140 are preferably slightly less than twice the radius $R_{41a}$.

While lowering assembly 100 within upper section 41*a* of spool bore 40, engagement of expandable ring outer surface 131 with spool bore inner surface 41 along upper section 41*a* may generate frictional forces tending to urge expandable ring 130 to move axially upward along load ring cam surface 125. However, spool bore surface 41 slidingly engages expandable ring 130 prevents ring 130 from riding upward along cam surface 125 and expanding radially outward. As a result, expandable ring 130 is restricted and/or prevented from moving axially upward relative to expandable ring 130. In addition, engagement of load sleeve outer surface 141 with spool bore inner surface 41 along upper section 41 a generates frictional forces tending to urge load sleeve 140 to move axially upward relative to body 110 and snap ring 150. However, upper end 140*a* of load sleeve 140 axially abuts expandable ring 130, and thus, is restricted from moving axially upward relative to body 110 and snap ring 150. Load sleeve 140 is sized and configured such that snap ring 150 engages surface 146*a*, which prevents snap ring 150 from expanding radially outward as tubing hanger assembly 100 is lowered through upper section 41*a*. To reduce and/or minimize friction between the components of hanger assembly 100 and spool bore 40, the outer surface of hanger assembly 100 is preferably coated with a low friction material such as Xylan.

As best shown in FIG. 7, tubing hanger assembly 100 is axially lowered through spool bore 40 until load sleeve 140 is landed on shoulder 43. In particular, tubing hanger assembly 100 is lowered through spool bore 40 with running tool 200 until shoulder 141*b* of load sleeve 140 abuts and engages mating spool bore shoulder 43. Upon engagement of shoulders 43, 141*b*, load sleeve 140 is restricted and/or prevented from moving further downward within spool bore 40. Simultaneous with engagement of shoulders 43, 141*b*, expandable ring 130 is radially aligned with mating recess 42 along spool bore inner surface 41.

Referring now to FIGS. 8 and 9, locking of tubular hanger assembly 100 to spool 26 after engagement of shoulders 43, 141*b* will be described. Engagement of shoulders 43, 141*b* will be detected by a decrease in weight acting on running tool 200. At this point, upward forces applied to running tool 200 to support assembly 100 and tubing string 36 hung therefrom are decreased and hanger body 110 is allowed to be pulled axially downward in the direction of arrow 211 by the weight of tubing string 36 coupled to lower end 110*b* as shown in FIG. 8. Engagement of threads 113*a*, 122*b* of hanger body 110 and load ring 120, respectively, secures load ring 120 to body 110 and prevents relative axial movement therebetween. Thus, hanger body 110 moves axially downward within bore 40 along with load ring 120. Further, intermediate shoulder 116*c* of hanger body 110 axially abuts snap ring 150, thereby carrying snap ring 150 axially downward along with body 110. However, engagement of shoulders 43, 141*b* prevents load sleeve 140 from moving axially downward with hanger body 110, and engagement of expandable ring 130 with load sleeve 140 prevents expandable ring 130 from moving axially downward with hanger body 110. Thus, hanger body 110, load ring 120, and snap ring 150 move axially downward within bore 40 relative to load sleeve 140 and expandable ring 130 as shown in FIG. 8.

As load ring 120 moves axially downward relative to expandable ring 130, cam surface 125 slidingly engages mating frustoconical surface 132*a* of expandable ring 130 and urges expandable ring 130 radially outward in the direction of arrow 212 into recess 42. Body 110 and load ring 120 are generally free to move axially downward relative to expandable ring 130 and load sleeve 140 under the weight of tubing string 36 until shoulder 116*a* of hanger body 110 comes into engagement with shoulder 143*b* of load sleeve 140 as shown in FIG. 9. In this embodiment, shoulder 128 of load ring 120 engages expandable ring 130 as shoulders 116*a*, 143*b* come into engagement. With load sleeve 140 engaging spool bore shoulder 43 and shoulder 116*a* engaging shoulder 143*b*, further axially downward movement of load ring 120 and body 110 relative to expandable ring 130 and load sleeve 140 is prevented. As best shown in FIG. 9, load ring 120, expandable ring 130, and recess 42 are sized and configured such that expandable ring 130 fully engages mating recess 42 as shoulders 116*a*, 143*b* come into engagement, thereby mechanically locking tubing hanger assembly 100 within spool bore 40 and preventing hanger assembly 100 from moving axially within bore 40.

As previously described, snap ring 150 also moves axially downward with hanger body 110 relative to load sleeve 140. As best shown in FIG. 8, as snap ring 150 moves axially downward, snap ring 150 slidingly engages surface 146*a*, which restricts snap ring 150 from moving radially outward. However, as shown in FIG. 9, once snap ring 150 moves axially below surface 146*a*, it is free to expand radially outward in the direction of arrow 213 into lower recess 144 and engage surface 144*a* of load sleeve 140 (FIG. 10). In this embodiment, load sleeve 140 and snap ring 150 are sized and configured such that snap ring 150 clears recess 146 and expands radially outward into engagement with surface 144*a* as shoulders 116*a*, 143*b* come into engagement. As snap ring 150 expands radially outward, lower end 150*b* slidingly engages shoulder 116*b* of hanger body 110 and upper end 150*a* slidingly engages shoulder 144*b* of load sleeve 140. Once snap ring 150 moves into lower recess 144, load sleeve 140 is prevented from moving axially relative to hanger body 110, expandable ring 130, and snap ring 150. Namely, upper end 140*a* of load sleeve 140 axially abuts expandable ring 130, which is seated in recess 42, and annular shoulder 144*b* of load sleeve axially abuts snap ring 150, which engages shoulder 116*b*. Locking the axial position of load sleeve 140 with snap ring 150 and expandable ring 130 allows the velocity hanger 100 to be locked in a single trip without rotation in bore 40 of velocity spool 26.

Referring still to FIG. 9, upon engagement of shoulders 43, 141*b*, the portion of hanger body 110 extending axially below load sleeve 140 extends axially into lower section 41*b* of spool bore 40. As previously described, maximum outer diameter $D_{110}$ of body 110 is slightly less than twice the radius $R_{41b}$. Consequently, the portion of body 110 extending axially below load sleeve 140 may slidingly engage lower section 41*b* during nm in operations. Further, seal assemblies 180 sealingly engage lower section 41*b* of bore surface 41. In particular, resilient seal members 182 disposed in glands 181 are radially compressed between hanger body 110 and lower section 41*b* of spool surface 41, and sealingly engage body 110 and spool surface 41. As a result, seal assemblies 180 function to restrict and/or prevent fluids passing through spool bore 40 from flowing between hanger assembly 100 and spool 26.

Figure 11:
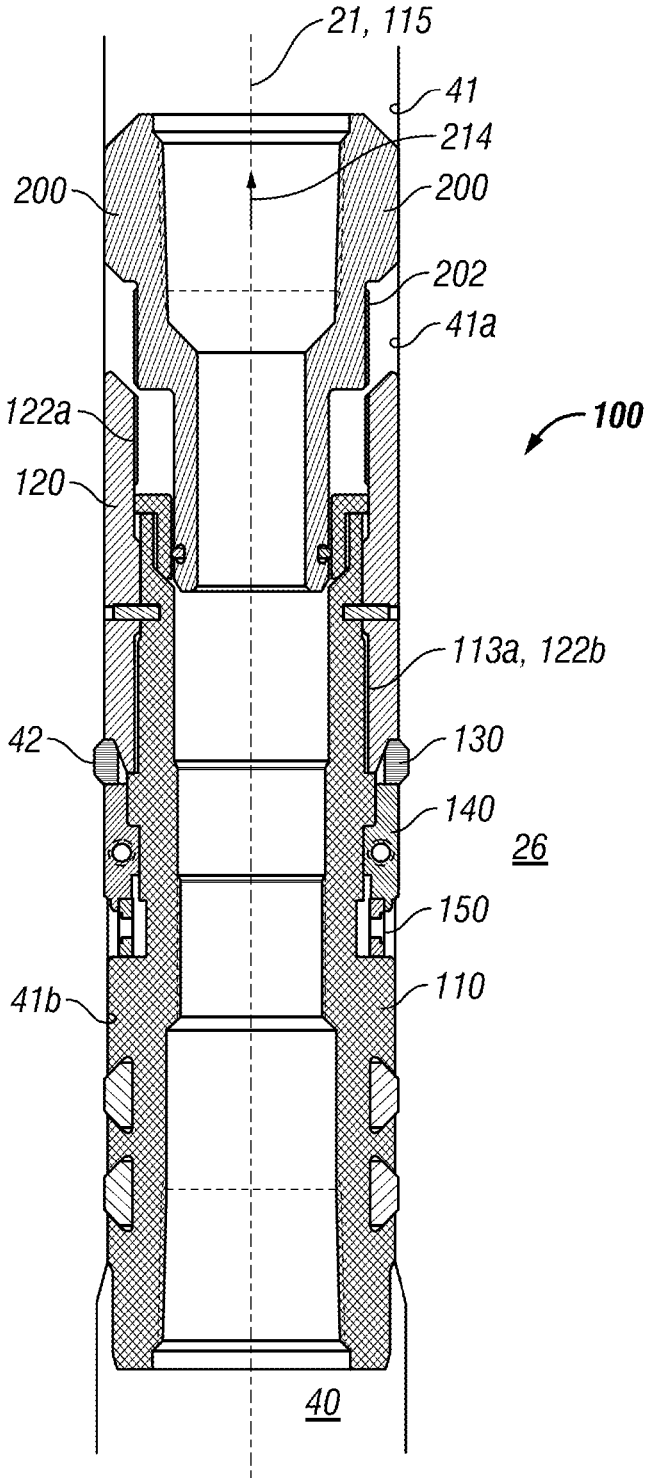

Referring now to FIGS. 10 and 11, with tubing hanger assembly 100 secured within spool bore 40 via positive engagement of expandable ring 130 and recess 42, and expandable ring 130 locked in position via load ring 120, load sleeve 140, and snap ring 150, running tool 200 is backed out by rotating running tool 200 relative to load ring 120 about axes 21, 115 to unthread mating threads 122*a*, 202. As previously described, threads 122*a*, 122*b* are threaded in opposite directions, and thus, unthreading running tool 200 from load ring 120 does not result in rotation of load ring 120 relative to hanger body 110 and inadvertent unthreading of mating threads 113*a*, 122*b* of load ring 120 and hanger body 110, respectively. In other words, unthreading of running tool 200 from load ring 120 does not result in unthreading of load ring 120 from hanger body 110. As shown in FIG. 10, once running tool 200 has been completely unthreaded and disengaged from load ring 120, it may be withdrawn from spool bore 40 and wellhead 20 in the direction of arrow 214, leaving tubing hanger assembly 100 fixedly secured to spool 26.

In the manner described, embodiments described herein provide a tubing hanger assembly (e.g., tubing hanger assembly 100) that is run in a spool bore of a wellhead (e.g., spool bore 40) and locked in position within the spool bore in a single trip without rotation.

Figure 12:
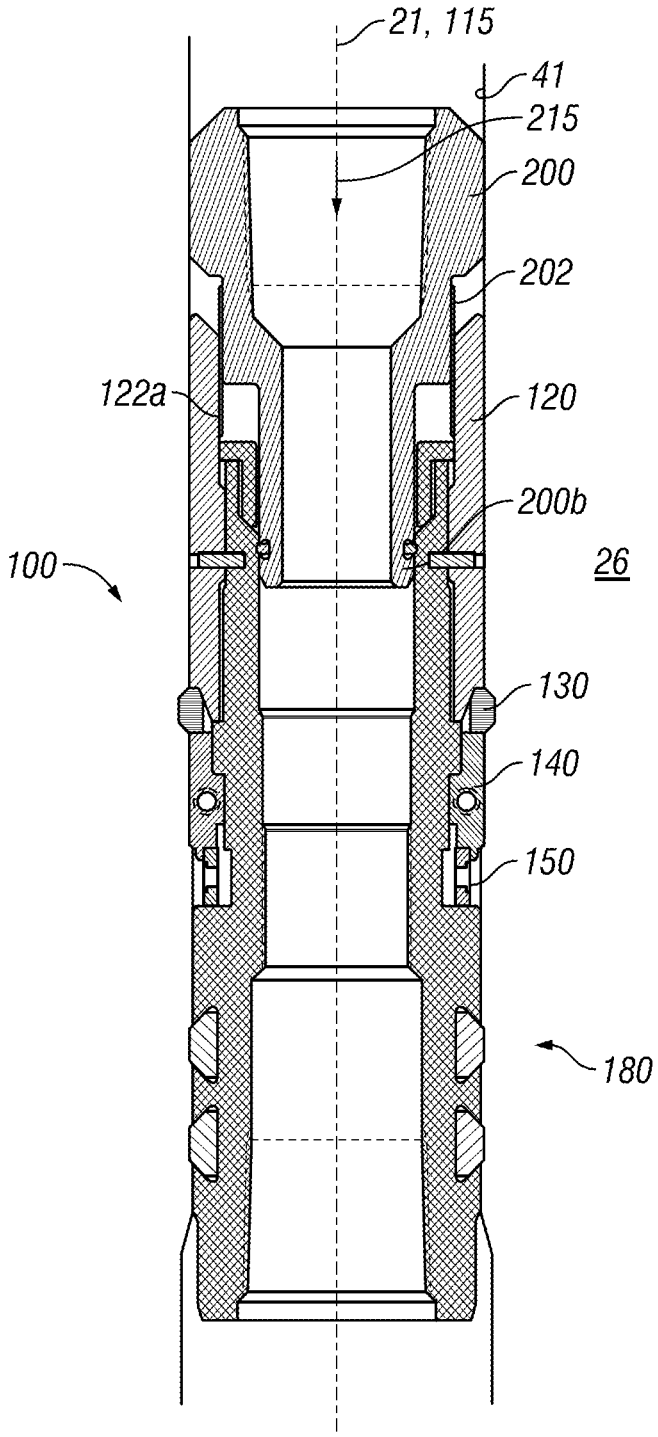
FIGS. 12-16 are sequential cross-sectional views of the tubing hanger assembly of FIG. 2 being retrieved from the spool of the production assembly of FIG. 1.
Figure 13:
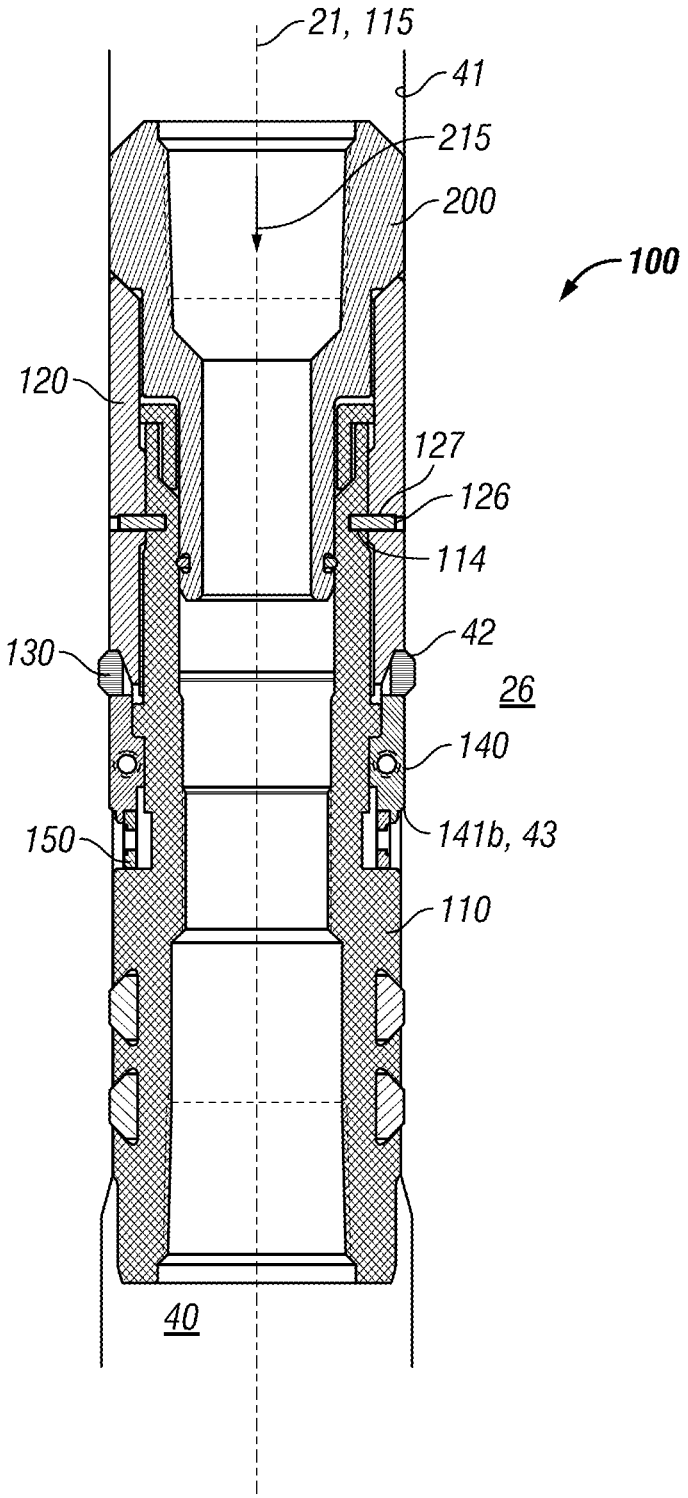
Figure 14:
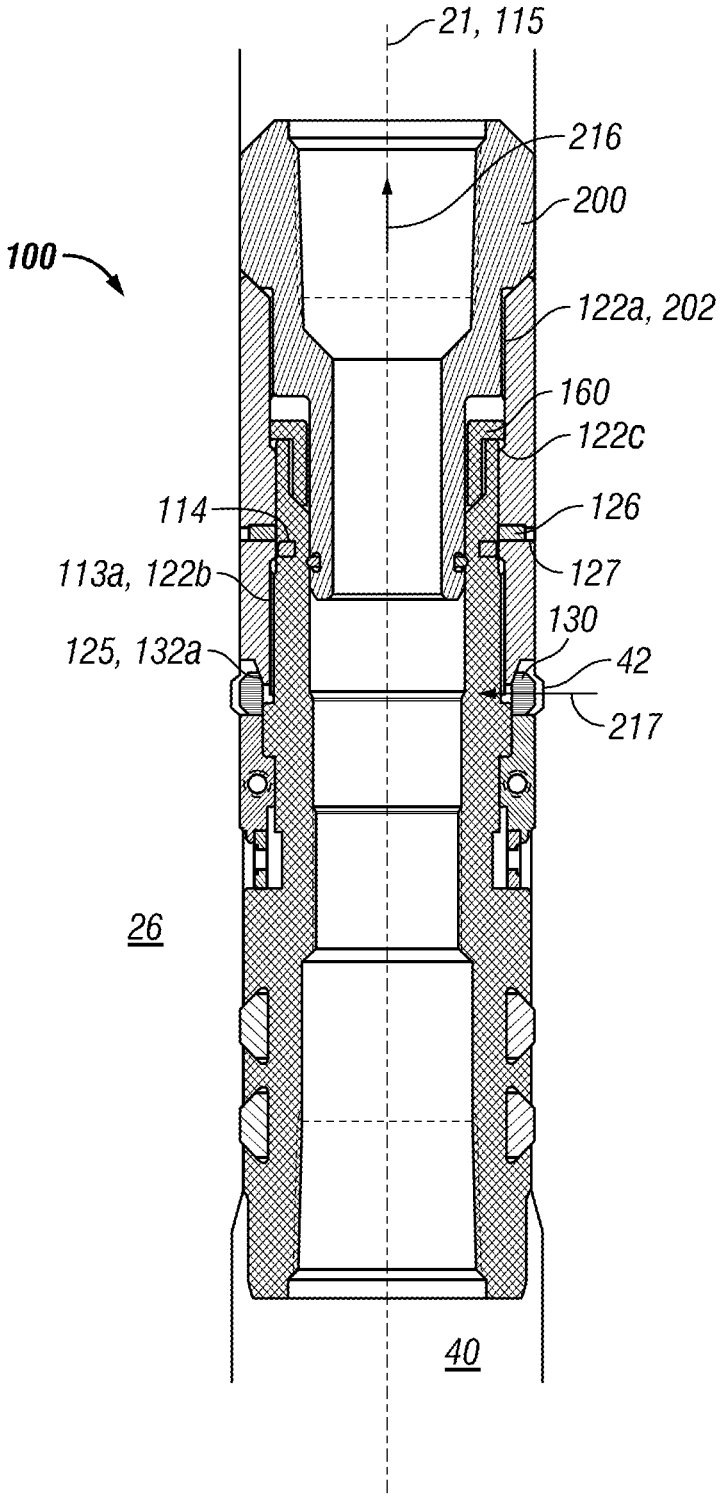
Figure 15:
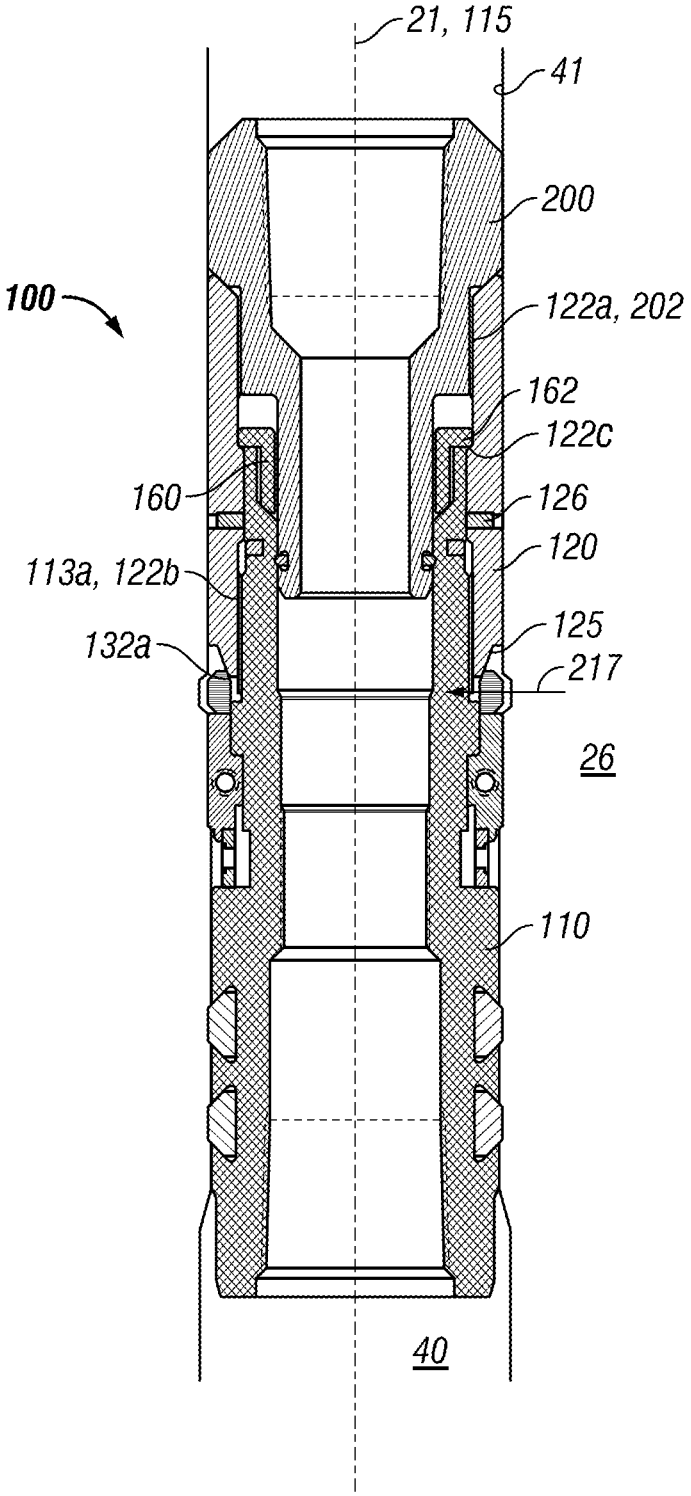
Figure 16:
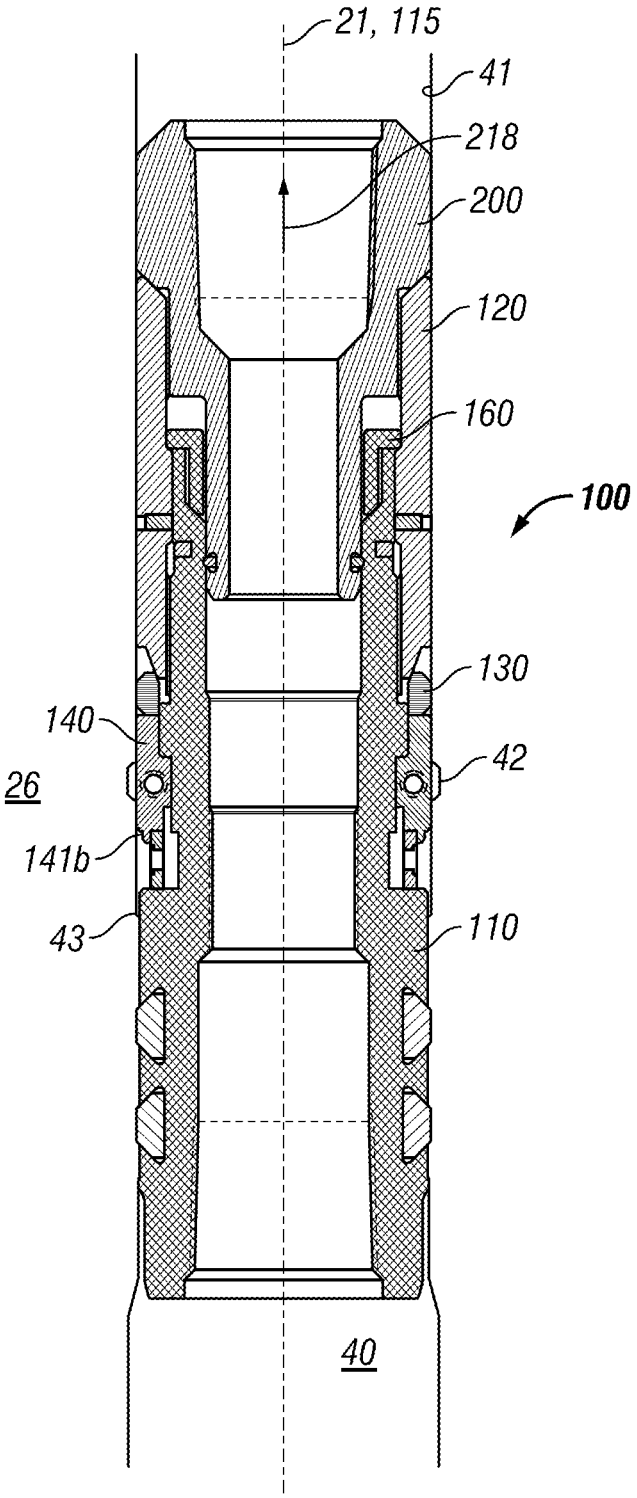

Referring now to FIGS. 12-16, the sequential steps for unlocking and retrieving tubing hanger assembly 100 from spool 26 are shown. In particular, FIGS. 12 and 13 illustrate running tool 200 being coupled to tubing hanger assembly 100, FIGS. 14 and 15 illustrate tubing hanger assembly 100 being unlocked from spool 26 after being coupled to tool 200 according to FIGS. 12 and 13, and FIG. 16 illustrates removal of tubing hanger assembly 100 from spool bore 40 after hanger assembly 100 is unlocked from spool 26 according to FIGS. 14 and 15. For purposes of clarity, tubing string 36 coupled to lower end 110*a* of hanger body 110 is not shown in FIGS. 12-16. However, as previously described and shown in FIG. 1, tubing string 36 is hung from the lower end 110*a* of hanger body 110 during run in, production, and retrieval operations.

Referring first to FIGS. 12 and 13, to initiate retrieval of tubing hanger assembly 100, which is secured and locked within bore 40 according to the procedures previously described with respect to FIGS. 6-11, running tool 200 is lowered axially into spool bore 40 in the direction of arrow 215 toward hanger assembly 100. Lower end 200*a* of running tool 200 is coaxially advanced into bores 111, 121 and rotated about axes 21, 115 relative to hanger assembly 100 to engage mating threads 122*a*, 202. As running tool 200 is threaded into load ring 120, the weight of tubing string 36 hung from lower end 110*b* of hanger body 110 generally restricts and/or prevents load ring 120 and hanger body 110 from rotating relative to spool 26 along with running tool 200.

Referring now to FIGS. 14 and 15, torque is applied to running tool 200 to rotate tool 200 and thread tool 200 into load ring 120. The torque continues to be applied after running tool 200 will no longer rotate relative to load ring 120 and thread further into load ring 120. Since threads 122*a*, 122*b* are opposite handed (i.e., threaded in opposite directions), continued application of sufficient torque to running tool 200 will begin to unthread load ring 120 from hanger body 110.

In this embodiment, mating threads 122*a*, 122*b* are right handed threads and mating threads 113*a*, 122*b* are left-handed threads. Thus, clockwise rotation of running tool 200 threads running tool 200 into load ring 120. Clockwise continues to be applied to running tool 200 even after running tool 200 will no longer rotate relative to load ring 120 and thread further into load ring 120. The clockwise torque may be increased, if necessary, to overcome static friction between mating threads 113*a*, 122*b* and begin to rotate running tool 200 and load ring 120 relative to hanger body 110, thereby beginning to unthread load ring 120 from hanger body 120 and move load ring 120 axially upward in the direction of arrow 216 relative to hanger body 110. Shear pins 126 extend radially through bores 114, 127 in hanger body 110 and load ring 120, respectively, and resist rotation of load ring 120 relative to hanger body 110. However, the clockwise torque applied to running tool 200 is sufficient to shear pins 126 and allow load ring 120 to rotate along with running tool 200 relative to hanger body 110. As load ring 120 is unthreaded from hanger body 110, the weight of tubing string 36 hung from lower end 110*b* of hanger body 110 generally restricts and/or prevents hanger body 110 from rotating relative to spool 26 along with load ring 120.

As load ring 120 is unthreaded from hanger body 110 via torque applied to running tool 200, load ring 120 moves axially upward in the direction of arrow 216 relative to hanger body 110. Further, as best shown in FIG. 14, due to engagement of expandable ring 130 with spool bore recess 42, load ring 120 moves axially upward relative to expandable ring 130, load sleeve 140, and snap ring 150. As load ring 120 continue to move axially upward relative to expandable ring 130, cam surface 125 slidingly engages mating frustoconical surface 132*a* of expandable ring 130. Since expandable ring 130 is biased radially inward, it contracts radially inward in the direction of arrow 217 and away from recess 42 as cam surface 125 slides upward along surface 132*a*. As best shown in FIG. 15, load ring 120 is unthreaded from hanger body 110 until annular shoulder 122*c* of load ring 120 axially abuts flange portion 162 of retainer ring 160, at which point continued unthreading of load ring 120 from hanger body 110 is restricted and/or prevented. Shoulder 122*c* is axially positioned along inner surface 122 of load ring 120 such that it engages flange portion 162 after expandable ring has radially contracted completely out of spool bore recess 42 and outer surface 131 of expandable member 130 is disposed at a radius less than $R_{41a}$. In other words, unthreading of load ring 120 from hanger body 110, and associated axial movement of load ring 120 relative to hanger body 110 is permitted at least until expandable ring 130 is completely removed from spool bore recess 42 as shown in FIG. 15. With expandable ring 130 disengaged and radially spaced apart from recess 42, the weight of assembly 100 and tubing string 36 is supported by engagement of shoulders 43, 141*b*.

Referring now to FIG. 16, after expandable ring 130 is completely removed from recess 42, an upward axial force in the direction of arrow 218 is applied to running tool 200 to lift and remove tubing hanger assembly 100 from spool bore 40. In the manner described, embodiments described herein provide a tubing hanger assembly (e.g., tubing hanger assembly 100) that is unlocked and removed from a spool bore of a wellhead (e.g., spool bore 40) in a single trip.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A tubing hanger assembly for suspending a tubing string into a wellbore, the assembly comprising:

a hanger body having a central axis, an upper end, a lower end, and a through bore extending axially between the upper and lower ends, wherein the hanger body has a radially outer surface including external threads axially disposed between the upper end and the lower end, the external threads having a first thread handedness;

a load ring coaxially disposed about the hanger body, wherein the load ring has an upper end and a lower end, wherein the load ring has a radially inner surface including a first set of internal threads that matingly engage with the external threads of the hanger body and a second set of internal threads axially spaced above the first set of internal threads, the second set of internal threads having a second thread handedness that is opposite the first thread handedness;

wherein the load ring has a radially outer surface including a frustoconical cam surface extending from the lower end of the load ring;

an expandable ring disposed about the hanger body and axially positioned adjacent the lower end of the load ring, wherein the expandable ring has a radially inner surface including a frustoconical surface that slidingly engages the cam surface; and a load sleeve coaxially disposed about the hanger body and having an upper end that engages the expandable ring and a lower end distal the expandable ring, wherein the load sleeve has a radially outer surface including an annular load shoulder.

2. The assembly of claim 1, wherein the expandable ring is a snap ring that is biased radially inward.

3. The assembly of claim 2, wherein cam surface and the frustoconical surface of the expandable ring are each oriented at an angle β relative to the central axis as viewed in cross-section in a plane containing the central axis, and wherein angle β is between 5° and 45° .

4. The assembly of claim 3, wherein angle β is between 10° and 25° .

5. The assembly of claim 2, further comprising a snap ring disposed about the hanger body, wherein the snap ring has an upper end that engages the load sleeve and a lower end that engages an annular shoulder disposed along the outer surface of the hanger body; and wherein the snap ring is biased radially outward.

6. The assembly of claim 5, wherein the load sleeve has a radially inner surface that includes a cylindrical surface that slidingly engages the hanger body and a first recess extending radially inward from the cylindrical surface, wherein the upper end of the snap ring is disposed in the first recess.

7. The assembly of claim 2, further comprising at least one shear pin extending radially through a mating bore in the load ring and a mating bore in the hanger body.

8. The assembly of claim 2, wherein the load sleeve is a split ring comprising at least two components disposed about the hanger body and secured together to form the load sleeve.

9. A method comprising:

(a) installing a wellhead including a spool and a bore through the spool, the bore including an annular recess and an annular hanger landing shoulder axially disposed below the recess;

(b) lowering a tubing hanger assembly into the bore, wherein the tubing hanger assembly includes:

a hanger body having a central axis, an upper end, and a lower end;

a load ring coaxially disposed about the hanger body, wherein the load ring has an upper end and a lower end, wherein the load ring has a radially outer surface including a frustoconical cam surface extending from the lower end of the load ring;

an expandable ring disposed about the hanger body and axially positioned adjacent the lower end of the load ring, wherein the expandable ring has a radially inner surface including a frustoconical surface that slidingly engages the cam surface; and a load sleeve coaxially disposed about the hanger body and having an upper end that engages the expandable ring and a lower end distal the expandable ring, wherein the load sleeve has a radially outer surface including an annular load shoulder;

(c) landing the load shoulder of the load sleeve against the landing shoulder of the bore;

(d) locking the tubing hanger assembly to the spool within the bore by expanding the expandable ring radially outward into the annular recess;

wherein (d) comprises allowing the hanger body and the load ring to move axially downward relative to the expandable ring under the weight of the tubing string.

10. The method of claim 9, further comprising threading a running tool into a bore in the load ring.

11. The method of claim 10, wherein (b) comprises lowering the tubing hanger assembly and the tubing string into the bore of the spool with the running tool.

12. The method of claim 11, wherein (d) further comprises:

slidingly engaging the frustoconical surface of the expandable ring with the cam surface of the load ring; and expanding the expandable ring radially outward into engagement with the recess in the spool bore.

13. The method of claim 12, further comprising:

(e) restricting the load sleeve from moving axially downward relative to the hanger body with a snap ring disposed about the hanger body and axially positioned between the load sleeve and an annular shoulder on a radially outer surface of the hanger body after (d).

14. The method of claim 10, further comprising:

(e) unlocking the tubing hanger assembly from the spool; and (f) removing the tubing hanger assembly from the spool bore after (e).

15. The method of claim 14, wherein (e) comprises:

(e1) threading the running tool into the load ring by rotating the running tool in a first direction about the central axis relative to the load ring;

(e2) applying torque in the first direction after the running tool ceases rotating in the first direction relative to the load ring;

(e3) unthreading the load ring from the hanger body by applying the torque in the first direction during (e2);

(e4) moving the load ring axially upward relative to the expandable ring during (e3); and (e5) allowing the expandable ring to contract radially inward and out of engagement with the recess.

16. The method of claim 15, further comprising:

(e6) lifting the tubing hanger assembly from the bore with the running tool after (e5).

17. The method of claim 9, wherein (b), (c), and (d) are performed in a single trip.

18. The method of claim 9, wherein the load sleeve comprises a radially inner surface that slidingly engages the hanger body.

* * * * *